United States Patent [19]

Smick

[11] 4,296,779

[45] Oct. 27, 1981

[54] TURBULATOR WITH GANGED STRIPS

[76] Inventor: Ronald H. Smick, 745 Chapel St., Ottawa, Ill. 61350

[21] Appl. No.: 82,576

[22] Filed: Oct. 9, 1979

[51] Int. Cl.[3] ..... B01F 15/06; F15D 1/02

[52] U.S. Cl. ..... 138/38; 165/179; 366/337

[58] Field of Search ..... 138/37, 38; 165/179, 165/181, 182, 183; 366/337

[56] References Cited

U.S. PATENT DOCUMENTS

| | | | |
|---|---|---|---|
| 3,235,003 | 2/1966 | Smith | 138/38 |
| 3,343,596 | 9/1967 | Kritzer | 165/179 |
| 4,044,796 | 8/1977 | Smick | 138/38 |
| 4,090,559 | 5/1978 | Megerlin | 165/179 |

*Primary Examiner*—Steven L. Stephan

*Attorney, Agent, or Firm*—Leydig, Voit, Osann, Mayer & Holt, Ltd.

[57] ABSTRACT

An improved turbulator unit for insertion in a heat exchanger tube with the turbulator having a plurality of elongated strips of metal each formed of a series of alternating deflection panels successively joined together by substantially triangular bridging portions with the strips being ganged together and anchored substantially on the axis of the tube by alternate ones of the bridging portions and the other bridging sections being disposed adjacent the inner wall of the tube.

10 Claims, 8 Drawing Figures

TURBULATOR WITH GANGED STRIPS

The present invention relates to turbulators for insertion inside heat exchanger pipes or conduits and more particularly concerns an improved turbulator with ganged deflection strips.

This invention is related to and an improvement on the turbulator disclosed and claimed in my U.S. Pat. No. 4,044,796, the disclosure of which is incorporated herein by reference. As discussed in that patent, various forms of turbulators have been proposed since about the turn of the century, which have made some improvement in mixing heat exchanger fluids, but which have had certain shortcomings including lack of uniformity of distribution of the heat exchanger fluid and/or too great of a flow restriction of the fluid within the heat exchanger tube. The turbulator disclosed and claimed in U.S. Pat. No. 4,044,796 represents a significant improvement over prior turbulator designs particularly in small to medium size heat exchanger conduits in that it assures complete mixing and uniform distribution of the heat exchanger medium against the internal walls of the heat exchanger tube without excessive flow restriction.

However, in large diameter heat exchanger tubes, I have found, contrary to my expectations, that a turbulator formed of a single strip of metal such as disclosed in U.S. Pat. No. 4,044,796 cannot simply be increased in scale to provide optimum conditions of turbulence and mixing with minimum flow restriction.

According to the present invention there is provided an improved turbulator with ganged deflection strips for more effectively mixing and uniformly directing fluids against the internal walls of a large diameter heat exchanger tube without excessive flow restriction of the heat exchanger fluid. It is also an object of this invention to provide a ganged turbulator for large diameter heat exchanger tubes which is easier and more economical to manufacture and yet which also fulfills the other objects and advantages of the single strip turbulator disclosed in my U.S. Pat. No. 4,044,796.

These and other objects and advantages of the invention will become more readily apparent upon reading the following detailed description and upon reference to the accompanying drawings, in which.

Figure 7:
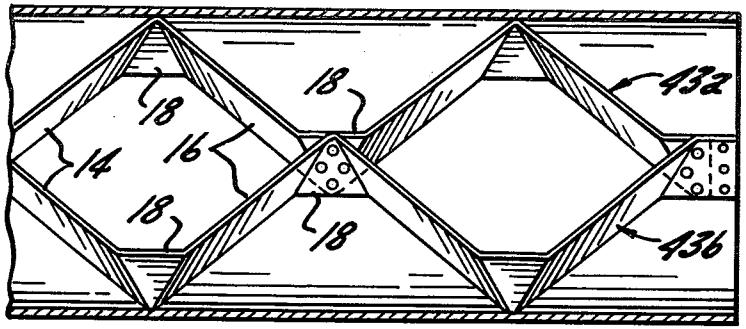
FIG. 7 is a side elevation view of another embodiment of a turbulator with the heat exchanger tube shown in vertical section.
Figure 8:
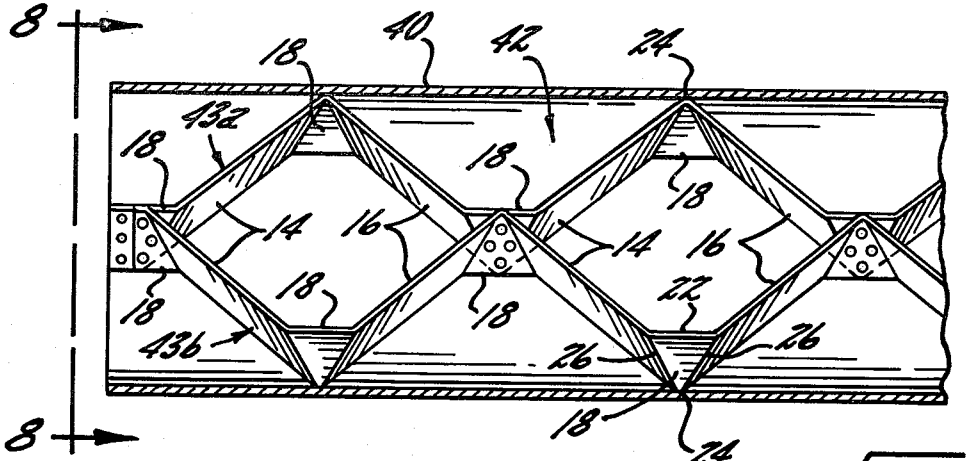
Figure 8:
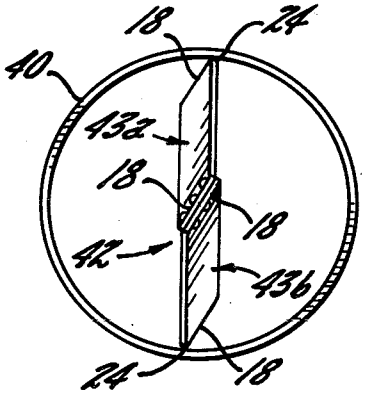

and,

FIG. 8 is an end view of the turbulator shown in FIG. 7 taken substantially along line 8—8.

While the present invention will be described in connection with certain preferred embodiments and procedures, it will be understood that I do not intend to limit the invention to those particular embodiments or procedures. On the contrary, I intend to cover all alternatives, modifications and equivalents as may be included within the spirit and scope of the invention as defined by the appended claims.

Figure 1:
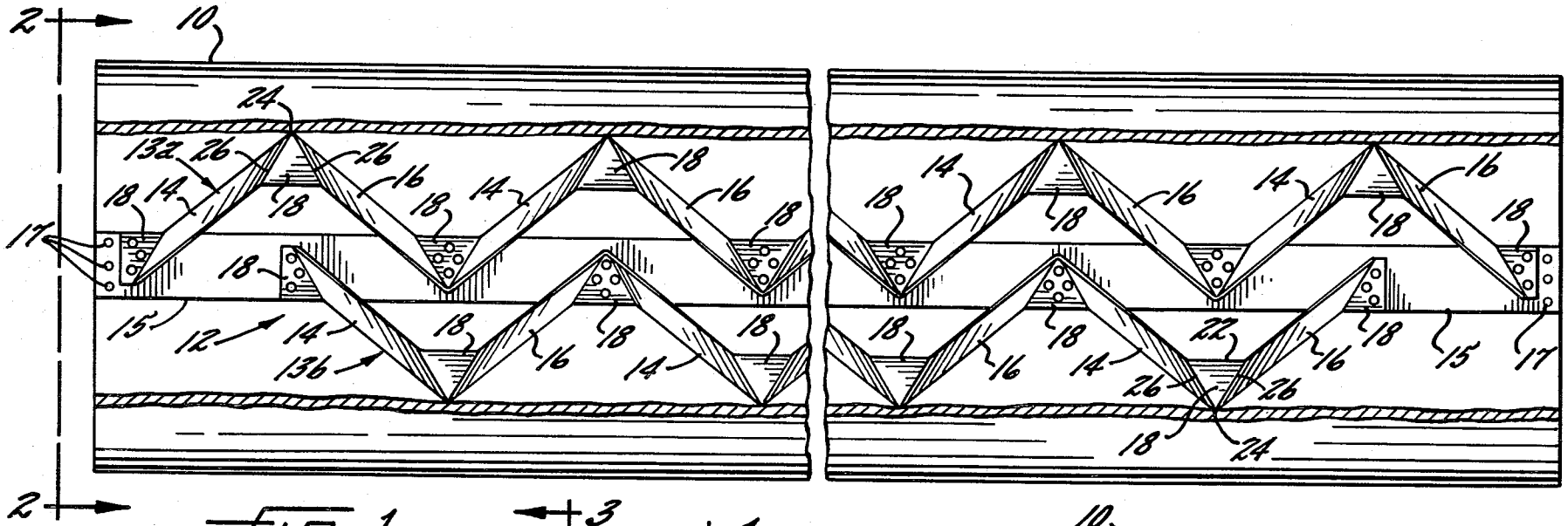
FIG. 1 is a side elevational view, with certain portions broken away, of a heat exchanger tube in which the improved turbulator of the present invention has been installed as seen substantially along line 1—1 in FIG. 2.
Figure 2:
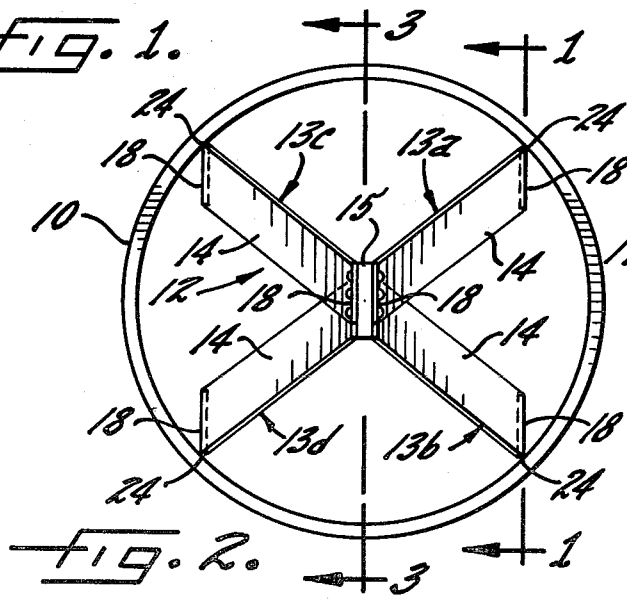
FIG. 2 is an end view of a heat exchanger tube in which the improved turbulator of the present invention has been installed as seen substantially along line 2—2 in FIG. 1.
Figure 3:
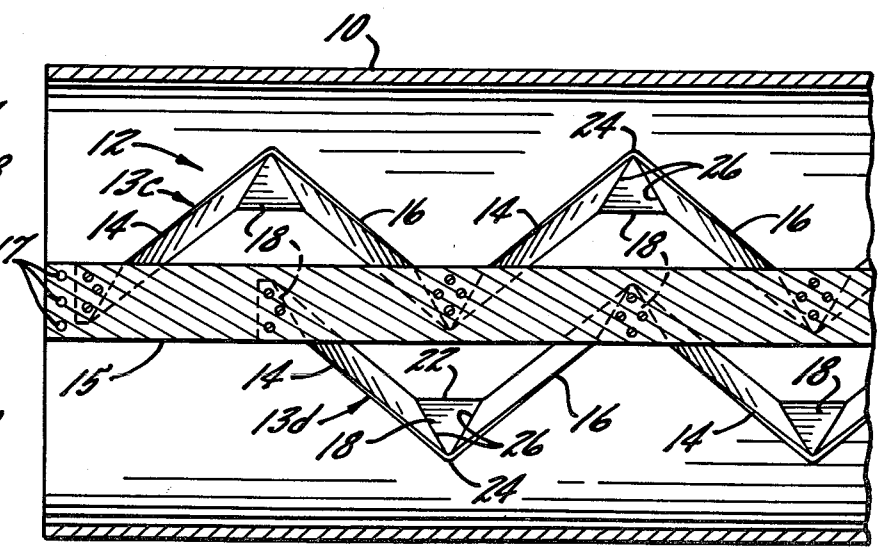
FIG. 3 is a vertically oriented longitudinal cross section of the tube and turbulator shown in FIGS. 1 and 2 taken substantially along line 3—3 in FIG. 2.

Turning now to the drawings, there is shown in FIGS. 1, 2 and 3 an exemplary heat exchanger tube or conduit 10 in which the improved turbulator 12 of the present invention is disposed. While the illustrated tube 10 is circular in cross section, it will be understood that it could be square, rectangular or, indeed, any other closed geometric shape.

In accordance with the present invention, the improved turbulator 12 is formed with a plurality of elongated strips of metal 13*a, b, c,* and *d,* each bent into a series of alternating deflection panels 14 and 16 successively joined together by substantially triangular bridging portions 18. As shown here, the strips 13*a–d* are ganged with alternate ones of their bridging portions 18 secured (such as by welding, bolts or rivets) to a relatively thin and narrow web 15 extending longitudinally of the tube 10 substantially along its axis. The web 15 may be provided with holes 17 at its ends for attachment to a further web or a handle or the like.

Referring particularly to FIGS. 1 and 2 and proceeding from the left end of FIG. 1, it will be seen that turbulator strip 13*a* has a terminal bridging portion 18 at its left end anchored to the web 15 along the axis of the tube 10 and the first deflection panel 14 is angled upwardly and outwardly therefrom to the next triangular bridging section 18 which, like the others, is formed with a base portion 22, an apex 24 and a pair of connecting legs 26. It will also be seen in FIGS. 1 and 2, that only the apexes 24 of the alternate bridging portions 18 engage the inner wall of the tube 10 thus minimizing metal contact, etching and the entrapment and accumulation of particulate matter from the heat exchanger fluid. The next deflection panel 16 of strip 13*a* angles downwardly and inwardly from the outer bridging portion 18 to the inner bridging portion 18 which is secured to the web 15.

Turbulator strip 13*b* is similar to 13*a* except that the first deflection panel 14 of strip 13*b* extends down and out from the web 15 to a lower portion of the tube 10 and the next panel 16 is then angled upwardly and inwardly back to the web where it is secured along the tube axis. It will also be seen that turbulator strips 13*a* and 13*b* are disposed in staggered relation along the length of the web 15 such that when the bridging portions 18 of strip 13*a* are disposed out adjacent the tube wall, the bridging portions 18 of strip 13*b* are disposed along the tube axis.

Referring now to FIG. 3, it will be appreciated that turbulator strips 13*c* and 13*d* are arranged similar to strips 13*a* and 13*b* but they are attached in staggered fashion to the other side of the web 15. The result, of course, is that from the end view (as seen in FIG. 2) the turbulator strips 13*a–d* are generally disposed in an X-shaped pattern although it should be appreciated that the panels 14 of the upper strips 13*a* and 13*c* are closer to the end of the tube 10 than the panels 14 of the lower strips 13*b* and 13*d*. It has been found that this generally X-like pattern of ganged and staggered turbulator strips 13*a*–13*d* which are also alternately angled up and down and tilted inwardly and outwardly with respect to the turbulator axis provides for highly efficient mixing and substantially uniform deflection of the fluid all around the inner surface of the tube 10, particularly in large diameter tubes, such as in the range of 18 to 42 inches.

Furthermore, this efficient mixing and uniform deflection is created without excessive flow restriction because each strip 13*a*–13*d* is relatively thin and narrow and at any given cross section of the tube 10 occupies only a small portion of the area. Additionally, each deflection panel 14 and 16 extends only from the tube axis to the inner wall of the tube 10 a distance which is substantially equal to r cosecant $\theta$. thus permitting the use of such thin narrow strips.

Figure 4:
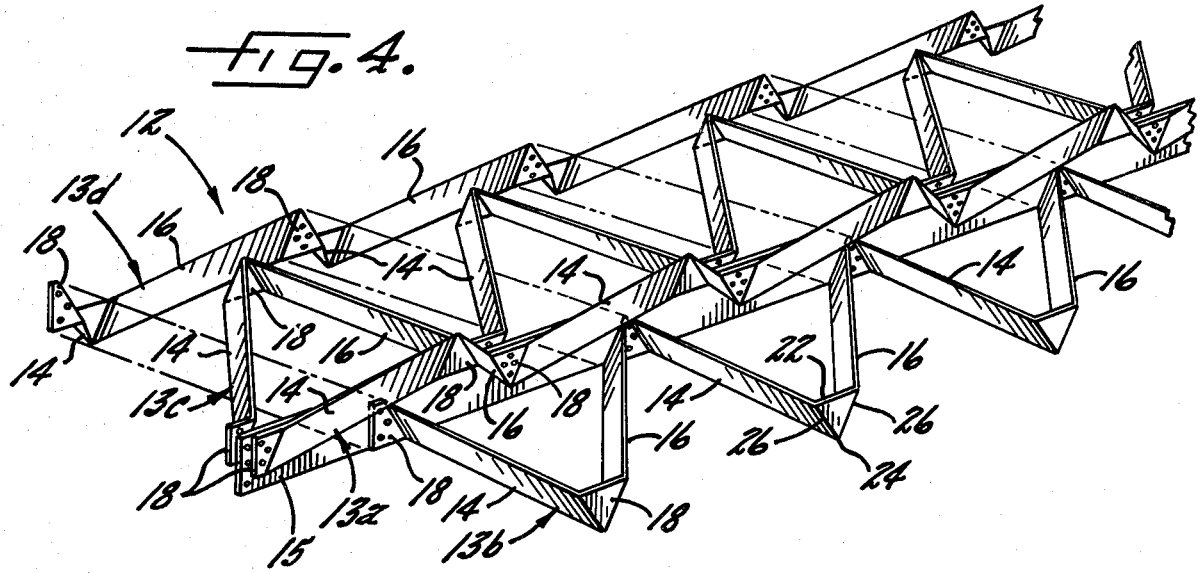
FIG. 4 is a modified perspective view with certain portions shown in expanded form of the improved turbulator shown in FIGS. 1–3.

In FIG. 4 a somewhat modified perspective view of the turbulator of FIGS. 1–3 is shown with strip 13*c* separated slightly from the back of the web 15 and strip 13*d* separated still further from the strip 15 for clarity of illustration. The alternate angling and tilting of the panels 14 and 16 of each strip 13*a*–13*d* and the staggered relation of strips 13*a* and 13*c* with respect to strips 13*b* and 13*d* is however, believed to be clearly shown in this expanded perspective view. As noted in FIG. 4 as well as FIGS. 1–3, the left end of each of the strips 13*a*–13*d* is anchored to the web 15 and this together with the anchoring of each alternate bridging portion 18 to the web results in a relatively rigid unit.

Figure 5:
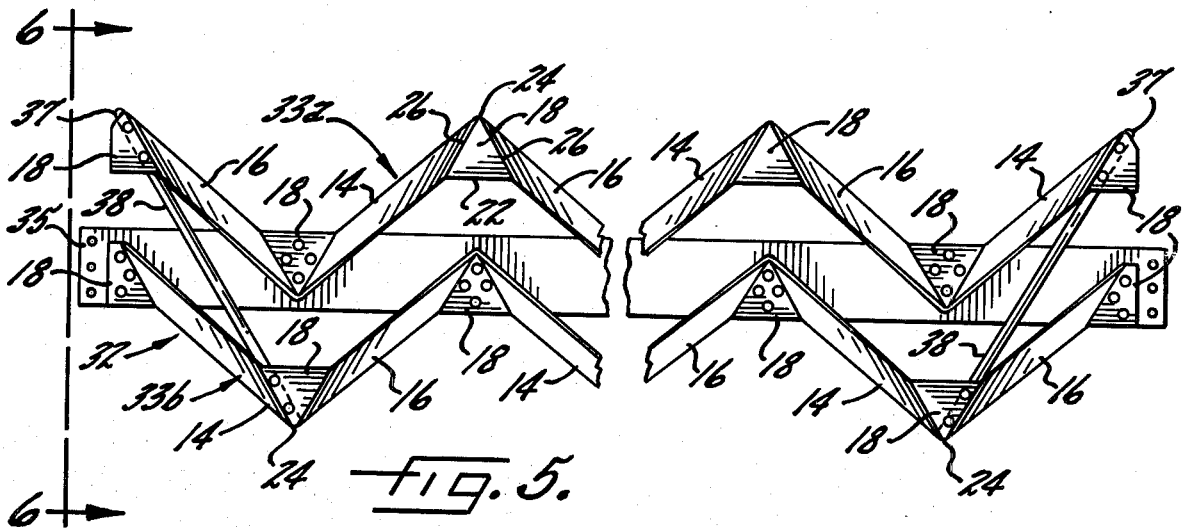
FIG. 5 is a side elevation view similar to FIG. 1 of a modified version of the turbulator of the present invention.
Figure 6:
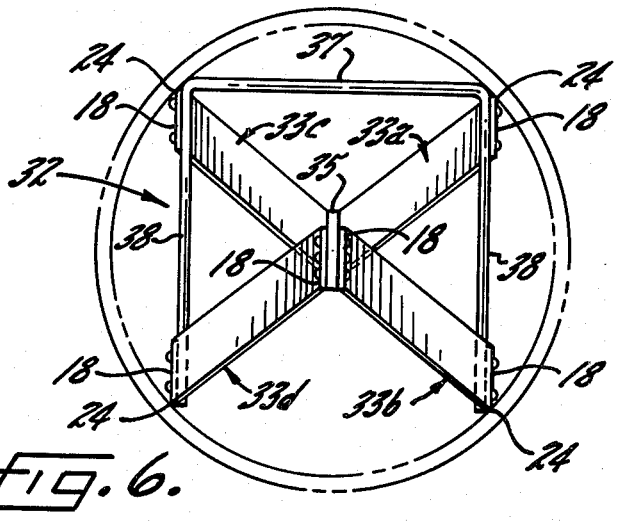
FIG. 6 is an end view of the turbulator shown in FIG. 5 taken substantially along line 6—6 with the heat exchanger tube shown in phantom.

A modified turbulator embodiment 32 is shown in FIGS. 5 and 6. Here the ends of the upper turbulator strips 33*a* and 33*c* are not anchored on the central web 35 but instead are secured (such as by welding, bolts or rivets) to a generally U-shaped support bracket 37 whose legs 38 are secured to the outwardly located bridging sections of the lower strips 33*b* and 33*d*. In this embodiment, more mixing and turbulence may be generated in a shorter length because all of the turbulator strips 33*a*–33*d* extend substantially the full length of the turbulator unit 32. This, of course, may be advantageous in certain installation situations.

Another turbulator embodiment 42, particularly suited for medium sized heat exchanger tubes 40 on the order of about a foot in diameter, is illustrated in FIGS. 7 and 8. As shown here, the turbulator 42 includes two strips 43*a* and 43*b* arranged with their alternate bridging sections 18 connected directly together (such as by welding, bolts or rivets). In this arrangement, the ganged turbulator strips 43*a* and 43*b* angle back and forth and together extend across the full diameter of the tube 40. Of course the deflection panels 14 and 16 of the strips 43*a* and 43*b* also alternately tilt in and out as in the prior embodiments. It will also be seen that for a given diameter tube 40 there is even less cross sectional area occupied by the turbulator 42 and thus even less flow restriction than in the prior embodiments. This may be desirable in certain installations.

From the foregoing, it will be appreciated that the present invention provides an improved turbulator with a plurality of ganged turbulator strips each of which angles alternately outwardly from the axis of the heat exchanger tube to the tube wall and then back in to adjacent the tube axis. As noted above, these embodiments provide for thorough mixing and uniform distribution of fluids all around the inner walls of the heat exchanger tube without creating undue flow restrictions. It will also be appreciated that such turbulators may be formed in varying lengths and further may be attached to one another in end-to-end relation (such as by the bolt holes provided), if long lengths are required for particular installations. This further facilitates ease of manufacturing, inventory control, storage, shipment and installation which together with the relative light weight strips that are employed leads to greater economy.

I claim as my invention:

1. An improved turbulator unit for insertion in a heat exchanger tube having substantially straight longitudinal internal walls, comprising, in combination, a plurality of elongated turbulator strips of metal each formed of a series of alternately angling and oppositely tilting deflection panels successively joined together by substantially triangular bridging portions, said strips being ganged together with every other one of said triangular bridging portions of opposing ones of said strips being disposed and anchored substantially on the axis of the heat exchanger tube and the other ones of said triangular bridging portions of each turbulator strip disposed with the apexes thereof directed toward and adjacent the inner wall of said tube.

2. An improved turbulator as defined in claim 1 including four of said elongated strips attached by said every other one of said bridging sections to a web extending longitudinally along the axis of said tube such that said turbulator has a generally X-shaped configuration when viewed from the end.

3. An improved turbulator as defined in claim 2 wherein said elongated strips are disposed in upper and lower pairs.

4. An improved turbulator as defined in claim 3 wherein said upper pair of strips are attached to said web in longitudinally staggered relation to said lower pair of strips.

5. An improved turbulator as defined in claim 2 wherein the ends of said strips are attached to said web.

6. An improved turbulator as defined in claim 3 wherein the ends of one pair of said strips are attached to said web and the ends of the other pair of said strips are secured to bracket means supported by the next adjacent bridging portion of the strips of said one pair.

7. An improved turbulator as defined in claim 6 wherein said bracket means is in the form of an inverted generally U-shaped bracket, the legs of which are supported by the bridging portions of the strips of said one pair.

8. An improved turbulator as defined in claim 1 including means for attaching said turbulator in end-to-end relation to another of said turbulators.

9. An improved turbulator as defined in claim 1 including two of said elongated strips attached to each other at alternate ones of said triangular bridging portions with said attached bridging portions being inverted with respect to each other.

10. An improved turbulator as defined in claim 9 wherein said turbulator appears generally as a tall, narrow parallelogram when viewed from the end.

* * * * *